US006538613B1

(12) United States Patent
Pursiheimo

(10) Patent No.: US 6,538,613 B1
(45) Date of Patent: Mar. 25, 2003

(54) ARRANGEMENT FOR AIMING A RADIO LINK ANTENNA

(75) Inventor: Juhani Pursiheimo, Helsinki (FI)

(73) Assignee: Nokia Corporation, Helsinki (FI)

( * ) Notice: Subject to any disclaimer, the term of this patent is extended or adjusted under 35 U.S.C. 154(b) by 0 days.

(21) Appl. No.: 09/889,125

(22) PCT Filed: Jan. 20, 2000

(86) PCT No.: PCT/FI00/00044

§ 371 (c)(1),
(2), (4) Date: Jul. 11, 2001

(87) PCT Pub. No.: WO00/44067

PCT Pub. Date: Jul. 27, 2000

(30) Foreign Application Priority Data

Jan. 20, 1999 (FI) ..... 990107

(51) Int. Cl.[7] ..... H01Q 3/00
(52) U.S. Cl. ..... 343/757; 342/359
(58) Field of Search ..... 343/757, 760, 343/765, 912, 711, 713; 342/359; 33/270

(56) References Cited

U.S. PATENT DOCUMENTS 5,189,555 A 2/1993 Jörlöv ..... 359/618
5,313,213 A 5/1994 Neumann et al. ..... 342/168
5,760,739 A * 6/1998 Pauli ..... 343/757
6,087,985 A * 7/2000 Rummeli et al. ..... 342/359

FOREIGN PATENT DOCUMENTS

DE 3406867 10/1984 ..... H01Q/3/08

* cited by examiner

*Primary Examiner*—Hoang Nguyen
(74) *Attorney, Agent, or Firm*—Cohen, Pontani, Lieberman & Pavane

(57) ABSTRACT

The invention relates to a method for aiming an antenna, in which method the antenna (A1, A2) is installed in a desired position in order to aim the antenna (A1, A2) at a target (A1, A2) for the reception, transmission or reception and transmission of radio signals. According to the invention, the direction (LOS) of the target (A1, A2) for selecting the position of the antenna (A1, A2) is determined using an optical sight (S, S1, S2, S3, S4, S5). Further according to the invention the sight (S, S1, S2, S3, S4, S5) is fitted in a predetermined position with respect to the position of the antenna (A1, A2) to be aimed, and the sight (S, S1, S2, S3, S4, S5) is aimed at the target (A1, A2) in order to determine at the same time the position of said antenna (A1, A2).

14 Claims, 4 Drawing Sheets

ARRANGEMENT FOR AIMING A RADIO LINK ANTENNA

PRIORITY CLAIM

This is a national stage of PCT application No. PCT/FI00/00044, filed on Jan. 20, 2000. Priority is claimed on that application, and on patent application No. 990107 filed in Finland on Jan. 20, 1999.

FIELD OF THE INVENTION

The present invention relates to a method for aiming an antenna. The invention also relates to an apparatus for performing the aiming.

BACKGROUND OF THE INVENTION

It is known to use permanent and semipermanent radio links in order to facilitate a typically bi-directional radio connection. Radio links relay telephone and data traffic as well as radio and TV signals between stations. The radio link is realized by means of electromagnetic radiation, i.e. radio waves, and the frequency of radio waves in a radio link may range from the RF wave band to the microwave region. Links may be 40 to 50 km long, in which case the link masts are typically 40 to 60 meters tall. Link antennas attached to the masts may be parabolic antennas, for example. Typically, there is a line-of-sight path between the radio link antennas so that radio wave propagation is free.

A known wireless transmission system for telephone and data traffic is the cellular-based public land mobile network (PLMN), such as GSM network, which facilitates wireless communication between a mobile station (MS), such as a mobile phone, and fixed parts of the system while the user of the mobile station moves in the system's operating area. The radio links between the fixed parts of the system are typically a few kilometers or even shorter, whereby the types and sizes of the antennas used may vary. They may be e.g. antennas attached to masts or walls of buildings that are aimed at their targets, say at an antenna attached to another mast. As a general rule, cell sizes are becoming smaller, which will partly result in a growing number of radio links and, hence, more antenna installations and modifications.

Antennas are used to transmit and receive radio waves, and the characteristics of antennas are similar in both transmission and reception. An antenna does not radiate in the same way in all directions but its characteristics may be represented by a radiation pattern which describes the correlation between e.g. the field strength radiated by the antenna and the direction. Indeed many antennas radiate strongly in one direction only, whereby the radiation pattern of such an antenna usually has one main lobe and, in addition to that, weaker side lobes. The radiation pattern is an important factor in antenna design, and radio link antennas are normally very directional, i.e. the main lobe is both vertically and horizontally narrow. It is then obvious that such an antenna has to be aimed at another, receiving, antenna carefully and with adequate precision. It is often advantageous that an antenna be highly directional so that it causes less disturbance to other antennas. The direction of the main lobe of an antenna is also dependent on the construction of the antenna, whereby in conjunction with the mechanical assembly of the antenna structure the position of the antenna may be chosen such that the antenna is aimed at its target, say another transmitting or receiving antenna. Additionally, the mounting elements of especially light antennas weighing a few kilograms include adjustment means for fine-tuning the orientation of the antenna.

In the prior art, the aiming of a radio link antenna, for example, has been carried out in such a manner that the field strength of the antenna is measured with a so-called AGC voltmeter. Naturally the measurement has to take place at the target, say at the other end of the radio link, at which the antenna is aimed, and advantageously at the location in which the other antenna is to be, or has already been, mounted. Aiming is carried out in such a manner that first the antenna is pointed to the rough direction of its target, using e.g. a compass, after which the antenna is mechanically turned using its fastening or adjustment means, such as adjustment screws. At the same time the field strength is measured with the voltmeter, and by mechanically turning the antenna one attempts to find the field strength maximum both vertically and horizontally. Thus the main lobe of the antenna is aimed at its target and the antenna can be locked in its position.

A considerable drawback in the method described above is that simultaneously with the aiming, the antenna has to be transmitting a signal in order to make possible the use of a voltmeter. This means that the power is switched on in the antenna, whereby a person or persons working with it must be very careful in order to avoid hazardous situations. However, with the voltmeter, the antenna can be easily aimed erroneously if, by accident, one measures the field strength of a strong side lobe at the target. This can happen particularly in a situation where the coarse direction of the antenna is incorrect or the installation team is unfamiliar with the properties of the antenna. Check-up measurements for the side lobes prolong the time it takes to complete the measurements and installation. Furthermore it should be noted that signal reflections from the surroundings affect the measured field strength, distorting measurement results and causing aiming errors.

Another considerable drawback is that in practice the aiming takes two installation teams, each placed in one end of the radio link and measuring and aiming the respective antennas. The installation teams may communicate so as to give aiming instructions to each other.

SUMMARY OF THE INVENTION

It is an object of the present invention to eliminate the aforementioned problems of the prior art and to introduce an entirely new method and apparatus to be used in the aiming of antennas. The invention is based on the idea that an optical sight is utilized in the aiming of antennas.

The invention makes the aiming of antennas considerably quicker and simpler than in the prior art. A special advantage of the invention is that during the aiming work the radio link antennas do not have their power switched on as the antennas are not aimed by measuring the field strength. Another special advantage of the invention is that the aiming can be carried out by a single installation team, even by a single person, if necessary.

A further special advantage of the invention is that the antenna need not be installed in its place for the aiming. This way the antenna can be delivered for subsequent installation. This has the special advantage that the aiming can be carried out already at the radio link building stage, at which point it would indeed be impossible to power up the antenna, or when the fastening means for the antenna is being installed. By fastening the sight in a predetermined position into e.g. a mounting flange mechanism designed for the antenna, said position being such that the sight can be aimed at the direction of the main lobe of the antenna, the sight can be aimed at the target by altering the position of the fastening means. Advantageously the position is altered using adjustment elements, such as adjustment screws, used for fine adjustment. At the same time the fastening means for the antenna is set in a position corresponding to that in which the antenna, when installed, is aimed at the target.

An advantage of the invention is that the aiming can be carried out reliably and quickly, for the aiming is not affected by side lobes, reflections, other antennas, etc. In particular the invention is applicable in short-range, line-of-sight (LOS) radio links where the distance between antennas is typically less than 500 m. The aiming accuracy required is typically about 0.5 to 1.0 degrees, so it is obvious that in longer ranges special attention must also be paid to the clearances of the fastening means and to the fastening of the sight.

Known optical sights typically have such constructions that the person using the sight sets himself on the same line with the target and sight, i.e. on the aim line, behind the sight. However, the distance between the antenna fastening means and the wall of a building, for instance, is typically very short, resulting in the problem that the person aiming the antenna does not have enough room to position himself behind the sight. In the apparatus according to the invention this problem is solved by fitting in the sight a prism or mirror which diverts the direction of the aim line. These can be fitted in a simple manner in front of or behind the sight, for example. Advantageously a prism is used which causes a smaller error in the refraction of light than a mirror. A considerable advantage of the invention is that the sight, the person or both can turn e.g. 90° to the side where there is enough room for working. In addition, a red dot sight is parallax-free, so the point of aim will not change even if it is viewed slightly off the center axis. This property reduces the possibility of error in installation.

A special additional advantage of the invention is that it can utilize sights usually known to be used in conjunction with bows, firearms, air guns or color cartridge guns, for example. With the invention, such sights will be used in a novel fashion and in a new operating environment as aiming devices, which considerably adds to their versatility.

BRIEF DESCRIPTION OF THE DRAWINGS

The invention will now be described in more detail with reference to the accompanying drawings in which.

DETAILED DESCRIPTION OF THE PRESENTLY PREFERRED EMBODIMENTS

Figure 1:
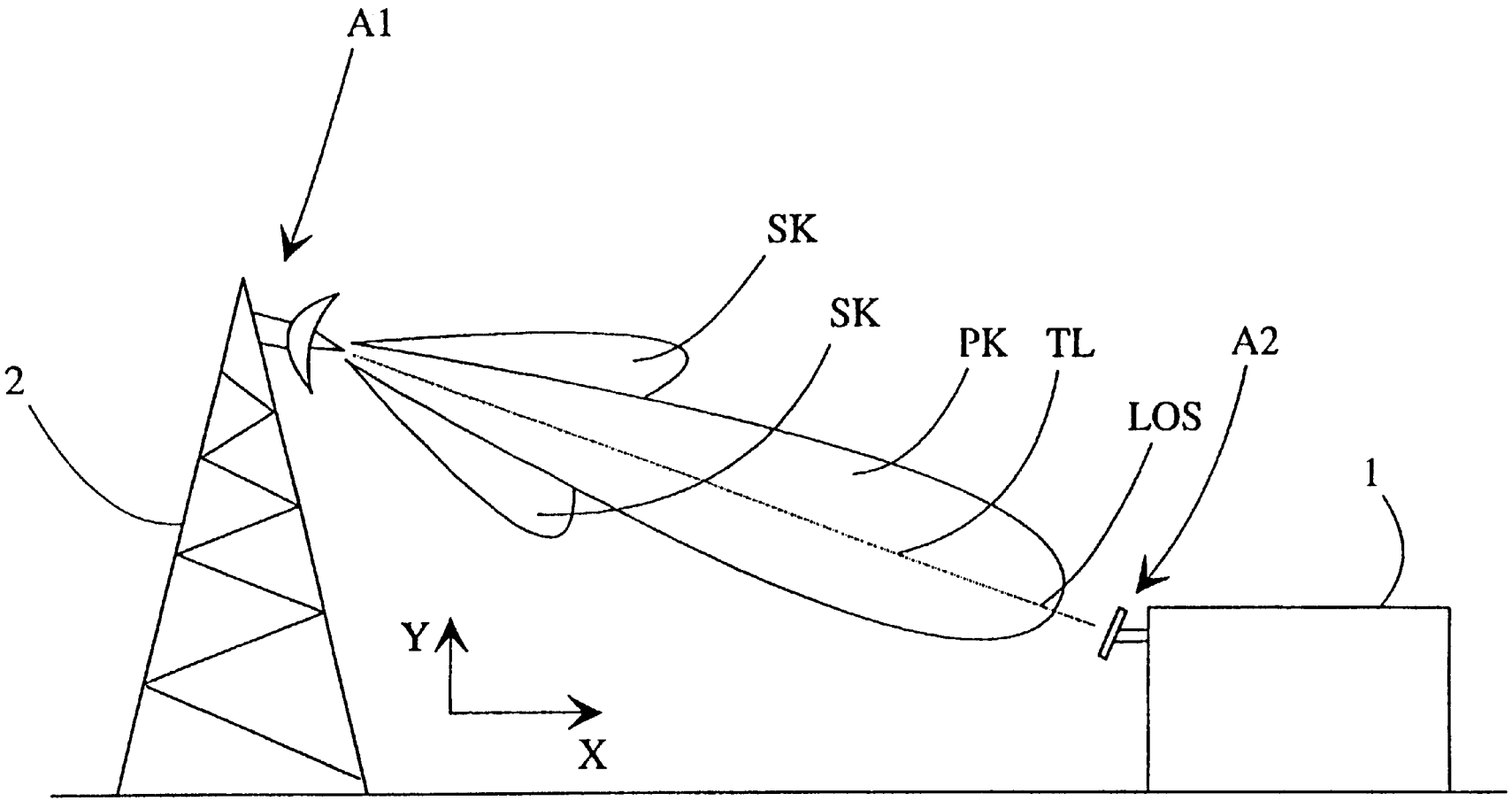
FIG. 1 illustrates in a simplified side view the aiming of radio link antennas, which is known as such.

FIG. 1 illustrates the aiming of two radio link antennas A1 and A2 to their targets, the target being in this case the other antenna. FIG. 1 shows the main lobe PK of antenna A1 and its two side lobes SK. The shapes of the lobes are shown as viewed from the side, i.e. in the vertical plane (arrow Y); in the horizontal plane (arrow X) the shapes may be similar, so the aiming has to be carried out in both planes. In the example illustrated, antenna A1 is attached to a radio mast 2 and antenna A2 to a wall of a building 1. FIG. 1 shows only the radiation pattern of antenna A1, but antenna A2 has a corresponding radiation pattern as well. It is obvious that the positions and types of antennas A1 and A2, as well as the shape and quantity of lobes PK, SK may vary in different cases.

Figure 2:
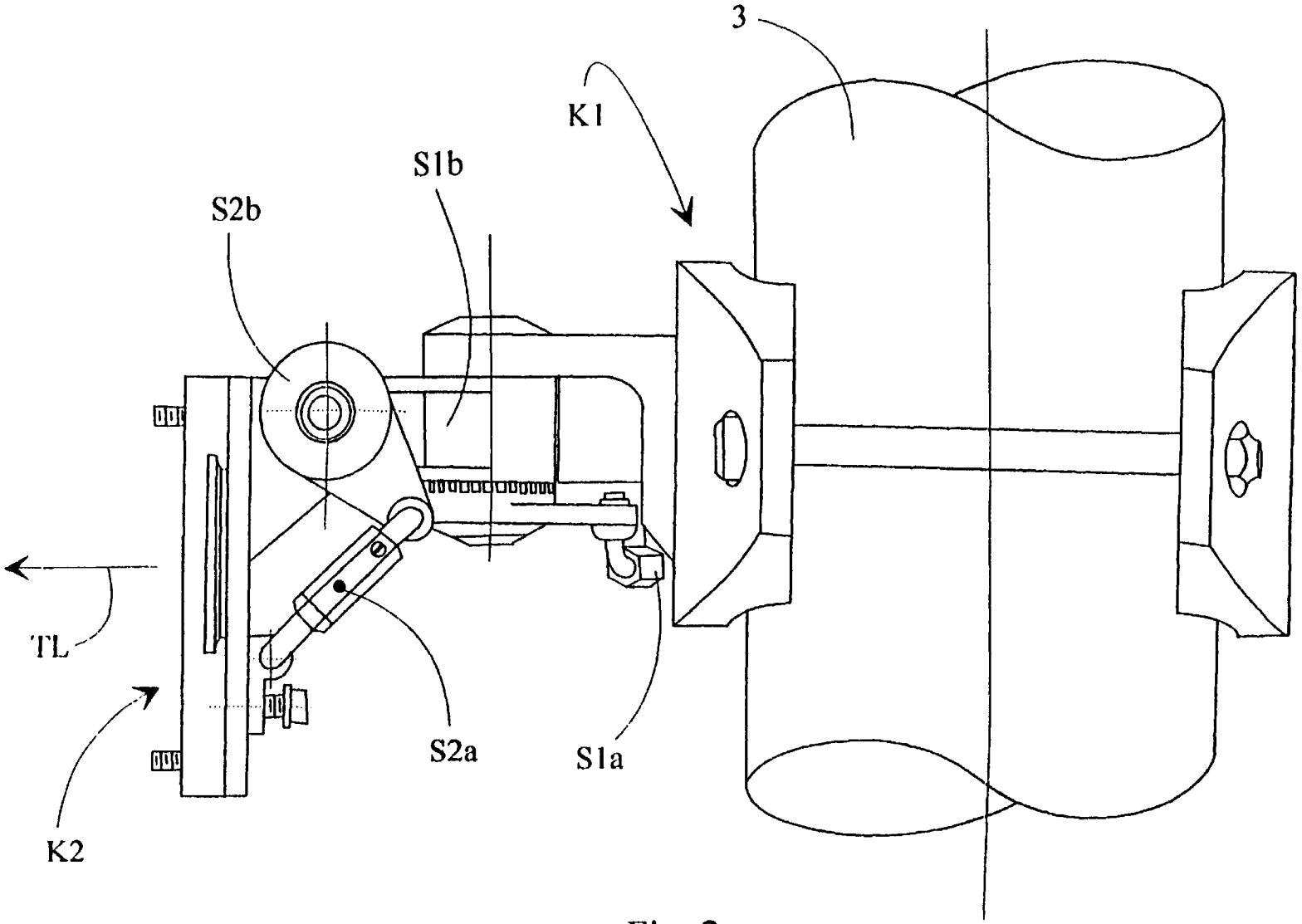
FIG. 2 shows a prior-art antenna fastening means with adjustment elements.

Further, FIG. 1 shows between antennas A1 and A2 a line of sight LOS which is congruent with the direction of the main lobe and with the aiming direction, or aim line TL, of the optical sight used in the method according to the invention. For reasons of antenna interoperability, an attempt is made in the aiming process to make the direction of the main lobe PK of antennas A1 and A2 to coincide with the line of sight LOS. This is normally done by altering the position and adjustments of the antenna fastening means. FIG. 2 shows an example of the fastening means with adjustment elements.

It is obvious that instead of a given target an antenna may be aimed at a desired direction, such as a compass course, a direction of the terrain, direction of a building, direction of a highway, etc. In this description, a target is understood to also mean such a target or direction selected primarily for the purpose of directing the desired aim line.

Referring to FIG. 2, the fastening means can be adjusted in the vertical plane typically by ±25–90° and in the horizontal plane by as much as ±180°. The fastening elements K comprise fastening parts K1 for attachment to e.g. a bar, mast, beam or the like 3. In the example described the bar 3 is vertical (arrow Y), but it is obvious that other orientations, too, are possible. In addition, the fastening parts K1 may comprise lockable articulations by means of which the position, relative to the bar 3, of the fastening elements K can be altered. The fastening elements K further comprise adjustment elements S1*a* and S1*b* for the coarse and fine adjustment in the horizontal plane and for locking. In addition, the fastening elements K comprise corresponding adjustment elements S2*a* and S2*b* for the coarse and fine adjustment in the vertical plane and for locking. The detailed structure of adjustment elements S1*a*, S1*b*, S2*a* and S2*b* may vary in different fastening elements, but their purpose is to provide a movable and lockable articulation to change the position, in relation to the fastening parts K1, of the antenna mount K2, such as e.g. mounting flange K2, in the fastening elements K. It is obvious that the adjustment elements S1*a*, S1*b*, S2*a* and S2*b* may be left out at least partly, in which case the position of the mounting flange K2 is changed by altering the fastening position of the fastening parts K1. The fine adjustment rods S1*a*, S2*a* and adjustment joints S1*b*, S2*b* in the adjustment elements are used to change and lock the direction of the aim line TL without releasing the fastening parts K1. The aim line TL depicted in FIG. 2 corresponds to the direction of the main lobe of the antenna (not shown) attached to the mounting flange K2. Attachment of the antenna itself is usually arranged in such a manner that as the antenna is mounted onto its place the direction of its main lobe is set in a predetermined relation to the antenna position and at the same time to the position of the mounting flange K2, so the direction of the main lobe can be determined by selecting the position of the mounting flange K2. Advantageously the direction is the direction of the aim line TL. As regards the implementation of the invention it is advantageous that the position of the antenna cannot be changed by means of the fastening parts (not shown) of the antenna itself, and that the position is changed only by means of the fastening parts K1 or adjustment elements S1*a*, S1*b*, S2*a* and S2*b*.

Figure 3:
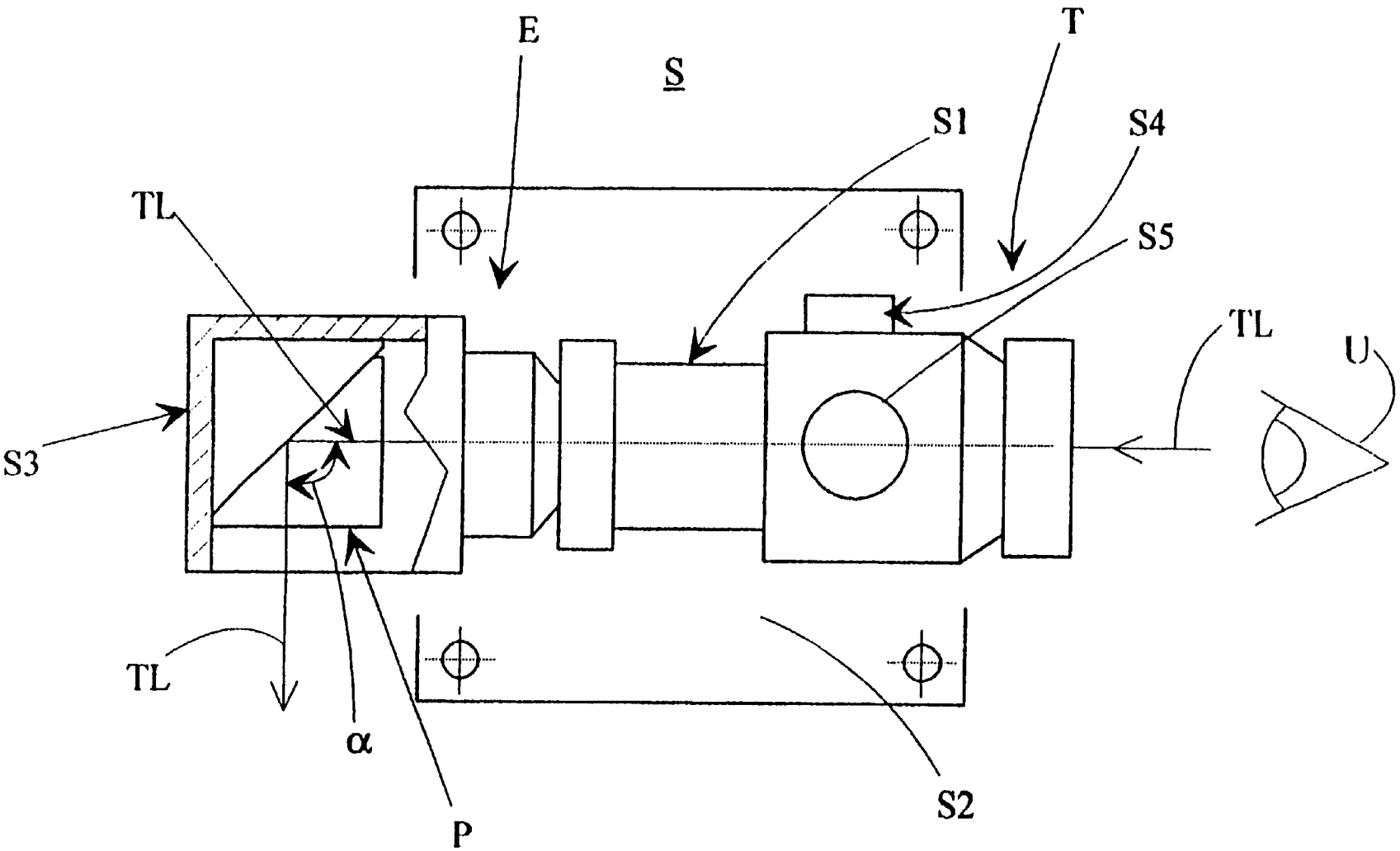
FIG. 3 is a partly cut-out side view of an optical sight used in aiming according to an advantageous embodiment of the invention.

FIG. 3 shows an optical sight S according to an advantageous embodiment of the invention, in particular a red dot sight S with a refractive element S3 attached to its front portion E. In FIG. 3, the refractive element S3, which affects the aim line TL, comprises a prism P which changes the direction angle α of the aim line TL by 90°. The aim line TL is determined on the basis of the construction and adjustments of the sight S. The refractive element S3 may also comprise a mirror installed at a 45-degree angle. The refractive element S3 may also be placed at the rear portion T of the sight S. When fitting the refractive element S3 to the front portion E or rear portion T of the sight S, it is an advantage that the sight portion S1 of the sight S may be a known and commercially available optical sight. It should be noted that said sights are intended to be used primarily in conjunction with firearms and, on the other hand, for measuring tree heights.

A known optical sight is e.g. the enlarging telescopic sight which may have a cross hair system or the like in order to align the aim point with the target. These sights are known as such and, therefore, a more detailed description of them is unnecessary in this context. Another known optical sight is the red dot sight. It is also called a reflex sight. Its operating principle is described e.g. in the U.S. Pat. No. 5,189,555. The rearmost lens of the sight may be left out entirely and the foremost lens may be adapted so as to be movable on an articulation. In this description, a red dot sight is understood to mean also a sight in which the shape of the aiming pattern formed on a lens by a light source differs from a point-like form, and is e.g. linear, cross-like, circular or the like. Moreover, the color of the aiming pattern may be other than red, being e.g. green. The reason for using red color is that red is easy to discern. Normally, such a sight does not enlarge and it has the special advantage of not being affected by a parallax error. When aiming the sight, the aiming pattern of the sight is superimposed on the target. The sight leaves free a larger area of the visual field, and because of fewer lenses the sight is more suitable for dim conditions than a multiple-lens telescopic sight. The telescopic sight is more suitable for longer ranges, but the adjustments of the sight have to be made with extra care because in long ranges even small angle errors result in considerable deviations from the line of sight in the horizontal direction.

In FIG. 3, the sight S has been fitted onto a mounting flange S2, which may be the mounting flange K2 shown in FIG. 2 or a separate mounting flange to which the sight portion S1 is attached. For use, the mounting flange S2 is fastened to the mounting flange K2 by means of screws or some quick-release mechanism, for example. The attachments can be realized in some known manner. The direction of view and the position of the user U are shown in FIG. 3. The refractive element S3 is shown partly cut out and comprises a prism P fitted to it in order to change the direction of the aim line TL. It is obvious that the change of direction can be other than 90°. For illustrative purposes, the aim line TL in FIG. 3 is directed downwards, but when the positions of the fastening elements K and mounting flange K2 are as in FIG. 2, the aim lines are advantageously congruent, whereby the aim line TL in FIG. 3 is directed perpendicularly upwards from the plane of drawing. Advantageously the position of the refractive element S3 can be stepwise rotated around the longitudinal axis of the sight S. The sight S depicted here additionally comprises adjustment screws S4 and S5 to determine the location of the red dot. Furthermore, the sight portion S1 is a model in which the lenses and source of light (not shown) of the sight are fitted inside a tubular encasing. It is furthermore obvious that additional elements can be fitted between the mounting flange K2 and mounting flange S2 to change the position of the sight S so that the directions of the aim lines TL shown in FIGS. 2 and 3 are congruent or are at least as close to each other as possible. It is also obvious that the construction of the mounting flange K2 may vary and be other than flange-like. As far as the invention is concerned it is important that the position of the sight S can be set into a predetermined and advantageously fixed position in relation to the antenna position so that when the sight S is aimed at a target, the position of the antenna is determined at the same time.

Figure 4:
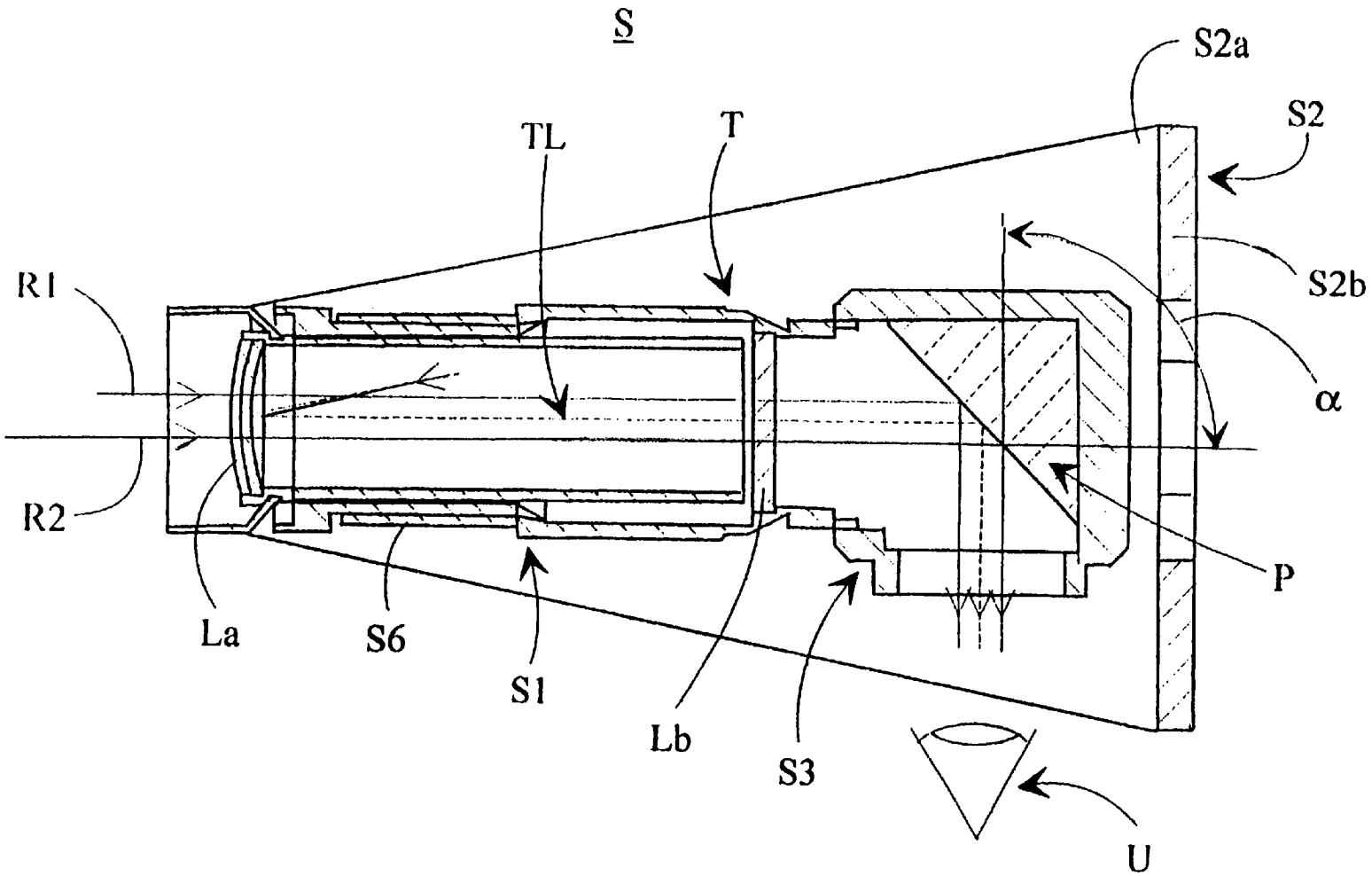
FIG. 4 is a cut-out side view of an optical sight used in aiming according to a second advantageous embodiment of the invention.

Moreover, the box-like refractive element S3 comprising a prism P and two apertures can be installed at the rear portion T of the sight portion S1, whereby possible angle errors caused by the prism P will not significantly affect the aiming accuracy since the red dot sight is parallax-free. FIG. 4 shows one such sight S. The refractive element S3 affecting the aim line TL comprises a mirror prism P which changes the direction angle α of the aim line TL by 90°. The sight S is fitted onto a mounting flange S2 that comprises two flange portions S2*a* and S2*b* attached to each other in an angular position, substantially perpendicularly. The sight portion S1 is fastened through elements S6 to the flange portion S2*a* in such a manner that line TL becomes substantially perpendicular with respect to the mounting flange S2*b* in order to aim the antenna. For use, the flange portion S2*b* is attached to a mounting flange K2 according to FIG. 2. FIG. 4 also shows the direction of view of the user U and his position to the side of the sight S. Preferably the aim line TL according to FIG. 4 is congruent with the aim line TL according to FIG. 2. The position of the refractive element S3 can advantageously be rotated around the longitudinal axis of the sight S and at the same time around the aim line TL. The sight portion S1 depicted is a model in which the sight lenses L*a*, L*b* and the source of light (not shown) are fitted inside a tubular encasing. The path of the ray from the light source is represented by a broken line congruent with line TL and, moreover, paths of rays of light from the target are depicted by lines R1 and R2.

As for the mechanical aiming of the antenna, the procedure according to a preferred embodiment of the invention is as follows. The direction for the aiming is selected roughly and the sight S functioning as aiming instrument is attached using e.g. a quick-release mechanism to the fastening elements K serving as an aiming device. The sight S is aimed at the target using the coarse adjustment elements, such as adjustment joints S1*b* and S2*b*, in the fastening elements K. After that, the sight S is aimed at the target using the fine adjustment elements, such as fine adjustment rods S1*a* and S2*a*. The position of the fastening elements K is locked, and the sight S is removed, after which the antenna is attached.

In accordance with a second preferred embodiment of the invention the antenna is attached to the fastening elements K, in which case there is a special point of attachment for the sight S, such as e.g. an attachment corresponding to the mounting flange K2. According to a third preferred embodiment of the invention that attachment may as well be fitted to the antenna itself, say to the protective structures or fastening elements of the antenna, whereby the sight S can be removed from the antenna after the aiming.

The present invention is not limited to the explanatory preferred embodiments described above but it can be modified within the scope of the claims attached hereto. For example, in addition to radio link antennas the invention finds utility also with other antennas that need to be aimed at a target or direction. Moreover, it is obvious that the compass course of a target, for instance, can also be determined using a known compass device fitted to the aiming device. Then, the position of the antenna and fastening means can be determined by a compass attached to them in a predetermined position. However, the method described earlier is more advantageous, for the aiming can be carried out with fewer work stages, at the same time avoiding the use of a separate compass device as well as errors caused by the determination of the compass course and the attachment of the compass.

What is claimed is:

1. A method for aiming an antenna, in which method the antenna (A1, A2) is installed in a desired position in order to aim the antenna (A1, A2) at a target (A1, A2) for the reception or transmission or both reception and transmission of radio signals, characterized in that the direction (LOS) of the target (A1, A2) for selecting the position of the antenna (A1, A2) is determined using an optical sight (S, S1, S2, S3, S4, S5) so that the optical sight (S, S1, S2, S3, S4, S5) is fitted to certain fastening elements (K, K1, K2) for the antenna (A1, A2), which fastening elements (K, K1, K2) are provided for the attachment and aiming of the antenna (A1, A2) and comprise adjustment elements (S1*a*, S1*b*, S2*a*, S2*b*) to change the position of the fastening elements (K, K1, K2), the optical sight (S, S1, S2, S3, S4, S5) is aimed at the target (A1, A2) by changing the position of the fastening elements (K, K1, K2) by means of said adjustment elements (S1*a*, S1*b*, S2*a*, S2*b*) and the antenna (A1, A2) is fitted to the fastening elements (K, K1, K2) after the position of the fastening elements (K, K1, K2) has been changed into the desired position by means of the sight (S, S1, S2, S3, S4, S5).

2. The method according to claim 1, characterized in that the sight (S, S1, S2, S3, S4, S5) is fitted into a predetermined position with respect to the position of the antenna (A1, A2) to be aimed and that the sight (S, S1, S2, S3, S4, S5) is aimed at the target (A1, A2) to determine at the same time the position of said antenna (A1, A2).

3. The method according to claim 2, characterized in that the aim line (TL) of the sight (S, S1, S2, S3, S4, S5) is adapted so as to be substantially congruent with the direction of the main lobe (PK) of the antenna (A1, A2).

4. The method according to claim 3, characterized in that the sight (S, S1, S2, S3, S4, S5) is attached to a mounting flange (K2) fitted to the fastening elements (K, K1, K2) for an antenna (A1, A2), which fastening elements (K, K1, K2) are provided for the attachment and aiming of the antenna (A1, A2).

5. The method according to claim 3, characterized in that the sight (S, S1, S2, S3, S4, S5) is a red dot sight.

6. The method according to claim 2, characterized in that the sight (S, S1, S2, S3, S4, S5) is attached to a mounting flange (K2) fitted to the fastening elements (K, K1, K2) for an antenna (A1, A2), which fastening elements (K, K1, K2) are provided for the attachment and aiming of the antenna (A1, A2).

7. The method according to claim 2, characterized in that the sight (S, S1, S2, S3, S4, S5) is a red dot sight.

8. The method according to claim 1, characterized in that the sight (S, S1, S2, S3, S4, S5) is attached to a mounting flange (K2) fitted to the fastening elements (K, K1, K2) for an antenna (A1, A2), which fastening elements (K, K1, K2) are provided for the attachment and aiming of the antenna (A1, A2).

9. The method according to claim 8, characterized in that the sight (S, S1, S2, S3, S4, S5) is a red dot sight.

10. The method according to claim 1, characterized in that the sight (S, S1, S2, S3, S4, S5) is a red dot sight.

11. An apparatus for aiming especially a radio link antenna (A1, A2) at a target (A1, A2), characterized in that in order to determine the position of the antenna (A1, A2) the apparatus (S, S1, S2, S3, S4, S5) comprises at least an optical sight portion (S1) which can be set in a predetermined position with respect to the position of the antenna (A1, A2) and aimed at the target (A1, A2), so that the optical sight (S, S1, S2, S3, S4, S5) is arranged to be fitted to certain fastening elements (K, K1, K2) for the antenna (A1, A2), which fastening elements (K, K1, K2) are provided for the attachment and aiming of the antenna (A1, A2) and comprise adjustment elements (S1*a*, S1*b*, S2*a*, S2*b*) to change the position of the fastening elements (K, K1, K2), the optical sight (S, S1, S2, S3, S4, S5) is arranged to be aimed at the target (A1, A2) by changing the position of the fastening elements (K, K1, K2) by means of said adjustment elements (S1*a*, Si*b*, S2*a*, S2*b*) and the antenna (A1, A2) is arranged to be fitted to the fastening elements (K, K 1, K2) after the position of the fastening elements (K, K1, K2) has been changed into the desired position by means of the sight (S, S1, S2, S3, S4, S5).

12. The apparatus according to claim 11, characterized in that the sight (S, S1, S2, S3, S4, S5) comprises a sight portion (S1) to which a refractive element (S3) is attached for the purpose of changing the direction of the aim line (TL).

13. The apparatus according to claim 12, characterized in that the aim line (TL) of the sight (S, S1, S2, S3, S4, S5) adapted so as to be attached to antenna fastening elements is adapted so as to be congruent with the direction of the main lobe (PK) of the antenna (A1, A2).

14. The apparatus according to claim 11, characterized in that the aim line (TL) of the sight (S, S1, S2, S3, S4, S5) adapted so as to be attached to antenna fastening elements is adapted so as to be congruent with the direction of the main lobe (PK) of the antenna (A1, A2).

* * * * *